US006446570B1

(12) United States Patent
Johnson

(10) Patent No.: US 6,446,570 B1
(45) Date of Patent: Sep. 10, 2002

(54) MANUAL PORTAGE SYSTEM FOR LIGHTWEIGHT WATER CRAFT

(76) Inventor: David A. Johnson, 19204 NE. 50th Ave., Vancouver, WA (US) 98686

( * ) Notice: Subject to any disclaimer, the term of this patent is extended or adjusted under 35 U.S.C. 154(b) by 0 days.

(21) Appl. No.: 09/907,837

(22) Filed: Jul. 17, 2001

Related U.S. Application Data

(60) Provisional application No. 60/218,586, filed on Jul. 17, 2000.

(51) Int. Cl.[7] ..... B60P 3/10
(52) U.S. Cl. ..... 114/344
(58) Field of Search ..... 114/344; 280/414.2

(56) References Cited

U.S. PATENT DOCUMENTS

| | | | | |
|---|---|---|---|---|
| 1,109,520 A | | 9/1914 | Flower | |
| 2,395,717 A | | 2/1946 | Bjork | 9/1 |
| 2,978,257 A | | 4/1961 | Barker | 280/179 |
| 3,210,783 A | * | 10/1965 | Petty | 114/344 |
| 3,687,476 A | | 8/1972 | Abbott | |
| 3,771,809 A | | 11/1973 | Carn | |
| 3,986,723 A | | 10/1976 | Brockelsby | |
| 4,059,282 A | | 11/1977 | Prickett | |
| 4,318,196 A | | 3/1982 | Eide | |
| 4,615,534 A | | 10/1986 | Blain | |
| 4,824,127 A | | 4/1989 | Stamm | |
| 5,295,556 A | | 3/1994 | Mullin | |
| 5,425,326 A | * | 6/1995 | Tibbedeaux | 114/344 |
| 5,547,209 A | * | 8/1996 | Vanderlinde | 280/414.2 |
| 5,755,451 A | | 5/1998 | O'Conner | |
| 6,032,964 A | | 3/2000 | Capobianco | |

* cited by examiner

*Primary Examiner*—Ed Swinehart
(74) *Attorney, Agent, or Firm*—Marger, Johnson & McCollom, P.C.

(57) ABSTRACT

A portage apparatus for a lightweight water craft having a central frame, comprising a receiver member attached to the central frame. A proximal end of an engaging member couples in a selected orientation to the receiver and is fastened thereto. A wheel permits the water craft to be manually lifted and rolled, wheelbarrow fashion. The receiver and engaging member preferably are tubular.

A method for portaging a water craft of a type having a central frame comprises attaching a receiver member to the central frame of the water craft. A wheel assembly is engaged with the receiver member and coupled thereto. The water craft may then be manually lifted and rolled in wheelbarrow fashion over land. The wheel assembly is then decoupled from the receiver member, and the water craft and receiver member is slid into the-water until the water craft floats on a water surface.

16 Claims, 3 Drawing Sheets

MANUAL PORTAGE SYSTEM FOR LIGHTWEIGHT WATER CRAFT

CROSS REFERENCE TO RELATED APPLICATIONS

This application claims priority from U.S. Provisional Application No. 60/218,586, filed on Jul. 17, 2000, which is incorporated by reference.

BACKGROUND OF THE INVENTION

The present invention is related to the field of conveyance on land of a boat, and more specifically to transporting an inflatable raft over land.

Watercraft are mobile in water but awkward to maneuver on land. Larger pleasure craft must be towed by trailer behind a motor vehicle and essentially backed directly into the water. Lighter craft, such as canoes, pontoon boats and rafts, can be maneuvered by hand, but such handling typically requires more than one person to accomplish.

Further, this latter type of craft is frequently used in areas where a conveniently located boat ramp is uncommon. Therefore, it is often necessary to convey the craft a substantial distance between the water and a trailer or other means by which the craft was delivered to the region.

Commonly, craft transport is undertaken along broken or uneven terrain or through narrow paths, trails and the like. It is therefore desirable that the craft mobilization over uneven ground be stable in terms of pitch and roll.

Devices for transporting a craft on land have been addressed by the prior art. For example, U.S. Pat. No. 1,109,520 to Flower teaches a rail-framed wheelbarrow-type caster for conveying a canoe. The caster apparatus engages the gunwales of the canoe. U.S. Pat. No. 4,059,282 to Prickett teaches a bow caster with an engaging clip for transporting an inverted boat. This caster comprises two side rail members and two U-shaped retaining members. U.S. Pat. No. 4,318,196 to Eide teaches a wheel-and-strut assembly that slides up into a stern-mounted guide. U.S. Pat. No. 5,755,451 to O'Connor discloses a wheel and strut assembly designed to fit into existing rudder gudgeons. Lastly, U.S. Pat. No. 6,032,964 to Capobianco teaches a two-wheeled kayak carting device having struts that fit into apertures formed within the hull of the kayak.

These prior art devices are typically bulky, heavy and ill-suited for use with lightweight water craft. The weight and size is important when the portaging device is meant to be stored aboard the water craft, and especially when the water craft is in use in the water.

Further, it is known that some mobilization systems include a pair of wheels, each of which is individually strapped to a respective pontoon. Such a system has a known disadvantage of requiring a wide path on which to maneuver the raft. Furthermore, such wheels cannot be firmly affixed to the pontoons. This limitation causes the craft to wobble when rolled.

SUMMARY OF THE INVENTION

The present invention overcomes these problems and limitations of the prior art.

Generally, the present invention provides a portage apparatus for a lightweight water craft having a central frame. The apparatus comprises a receiver member and means for attaching said receiver member to the central frame. A proximal end of the engaging member couples in a selected orientation to the receiver member and is fastened thereto. A wheel means, fixed to the distal end of the engaging member, permits the water craft to be manually lifted and rolled in wheelbarrow fashion over land.

In a preferred embodiment, the receiver member is tubular, comprising an open end leading to a hollow interior along a longitudinal axis of said tubular receiver member and further comprising a pair of coaxial holes formed through an outer wall of the receiver member. The engaging member is likewise tubular and comprises a pair of coaxial holes formed through an outer wall of the engaging member. The proximal end of the engaging member is received through the open end of the tubular receiver member into the hollow interior, such that the engaging member coaxial holes and receiver member coaxial holes are in substantial registry. The engagement is secured with a pin received through said coaxial receiver and engaging members.

A method for portaging a water craft of a type having a central frame comprises attaching a receiver member to the central frame of the water craft. A wheel assembly, including a wheel rotatably disposed on one end of the wheel assembly, is engaged with the receiver member and coupled thereto. The water craft may then be manually lifted and rolled in wheelbarrow fashion over land. The wheel assembly is then decoupled from the receiver member, and the water craft and receiver member is slid into the water until the water craft floats on a water surface.

The invention will become more readily apparent from the following Detailed Description, which proceeds with reference to the drawings, in which:

BRIEF DESCRIPTION OF THE DRAWINGS

FIG. 1 is a perspective view of the wheel assembly and receiver according to one embodiment of the present invention.

FIG. 2 is a perspective view of the wheel assembly and receiver of FIG. 1, wherein the wheel assembly and receiver are coupled.

DETAILED DESCRIPTION OF THE PREFERRED EMBODIMENT(S)

Figure 3:
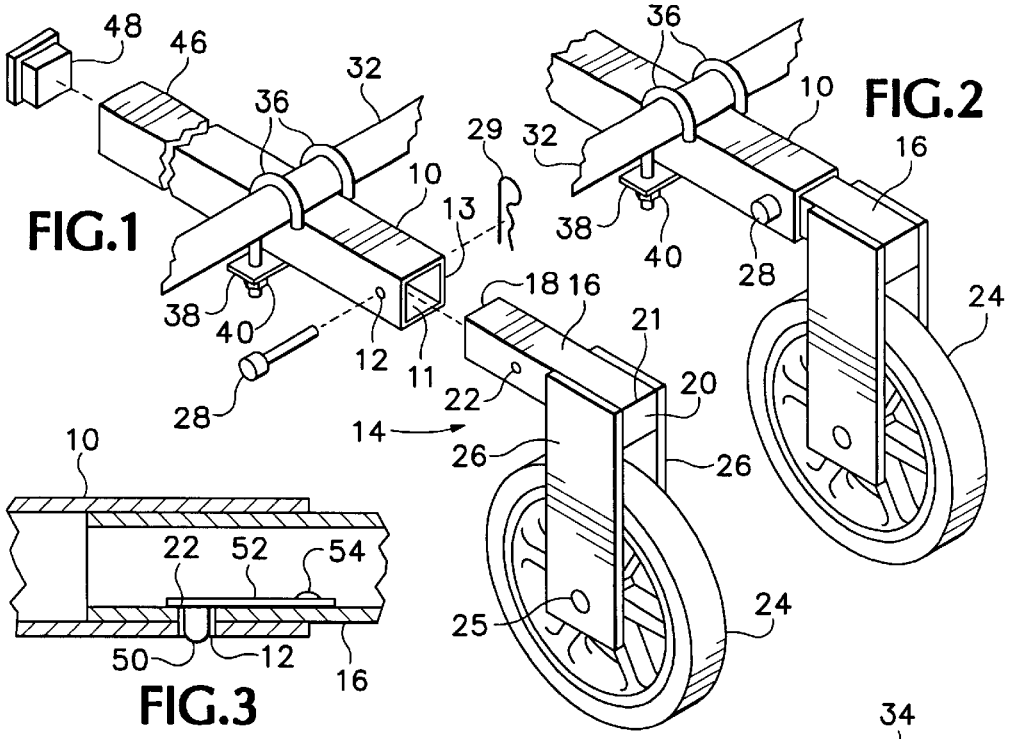
FIG. 3 is a section view of an alternate embodiment of the means for attaching the engagement member to the receiver in the wheel assembly of FIG. 1.

As has been mentioned, the present invention provides a portage apparatus for a water craft having a central frame. Turning to FIG. 1, the present invention comprises a receiver member 10 having a pair of coaxial holes 12, 12 disposed toward an open end 13 and passing through the receiver.

The apparatus of the present invention further comprises a wheel assembly 14 having an engaging member 16. The engaging member 16 has a proximal end 18 and a distal end 20, the distal end preferably capped to prevent water from flowing into the hollow interior of the engaging member 16.

Passing through the proximal end 18 are a pair of coaxial holes 22. The coaxial holes are shown in FIG. 1 to have a horizontal axis, but may be placed in a vertical or other desired orientation.

A wheel means 24 is affixed to the distal end 20 of the engaging member 16 by means of fork legs 26, 26, attached to engaging member 16 at an upper end thereof and at a lower end to wheel 24 via axle 25. The wheel means 24 can be of any material and size that will fit an application, but is preferably sized to be stored conveniently and unobtrusively on a water craft when the latter is in use on the water.

As shown in FIG. 2, the proximal end 18 of the engaging member 16 couples in a selected orientation to the receiver member 10. In the embodiment shown in FIGS. 1–2, the wheel assembly is coupled to the receiver such that the wheel is oriented downward and can contact the ground.

The preferred embodiment receiver is a tube having a non-circular cross-section. In the illustrated embodiment, a tubular receiver 10 and a tubular engaging member 16 each have a square cross-section. The engaging member 16 couples to the receiver 10 by sliding the proximal end 18 of the engaging member through the open end 13 of the receiver and into the hollow interior 11 of the receiver. The components can be coupled to the receiver in one of only four configurations. Similarly, use of oval cross-section tubes for the receiver and engaging member will result in only two coupling configurations. Other configurations can also successfully be employed. For example, coupling can be accomplished by mating a tongue of the engaging member into a slot in the receiver.

The receiver 10 and engaging member 16 are fastened together by means of a pin 28 or other fastening means. As shown in FIG. 2, the fastening means 28 is a pin inserted through the aligned pairs of coaxial holes 12,12 and 22,22. Another and preferred type of fastening means is a quick-release pin, such as an aircraft-style quick-release pin (Avibank Mfg., Inc., 11500 Sherman Way, North Hollywood, Calif. 91605, Model No. BLC6BC15S). Alternatively, each of the receiver and engaging member may be tubular and nest as described, with a quick-release collar fastening the two components together.

Yet another fastening means is shown in FIG. 3 in which each of the receiver 10 and engaging member 16 include a single hole formed through a wall thereof. A spring-loaded pin 50 is adapted to be received through both holes 12, 22 when the engaging member 16 is received within the receiving member 10 and the holes aligned. The pin 50 is attached to one end of a spring bar 52, the other end of bar 52 being attached to an inside wall of the engaging member 16 via bolt 54. To release the engaging member 16 of the wheel assembly from the receiver 10, the pin 50 is pressed inward thus allowing the engaging member 16 to be disengaged from receiver 10.

Figure 4:
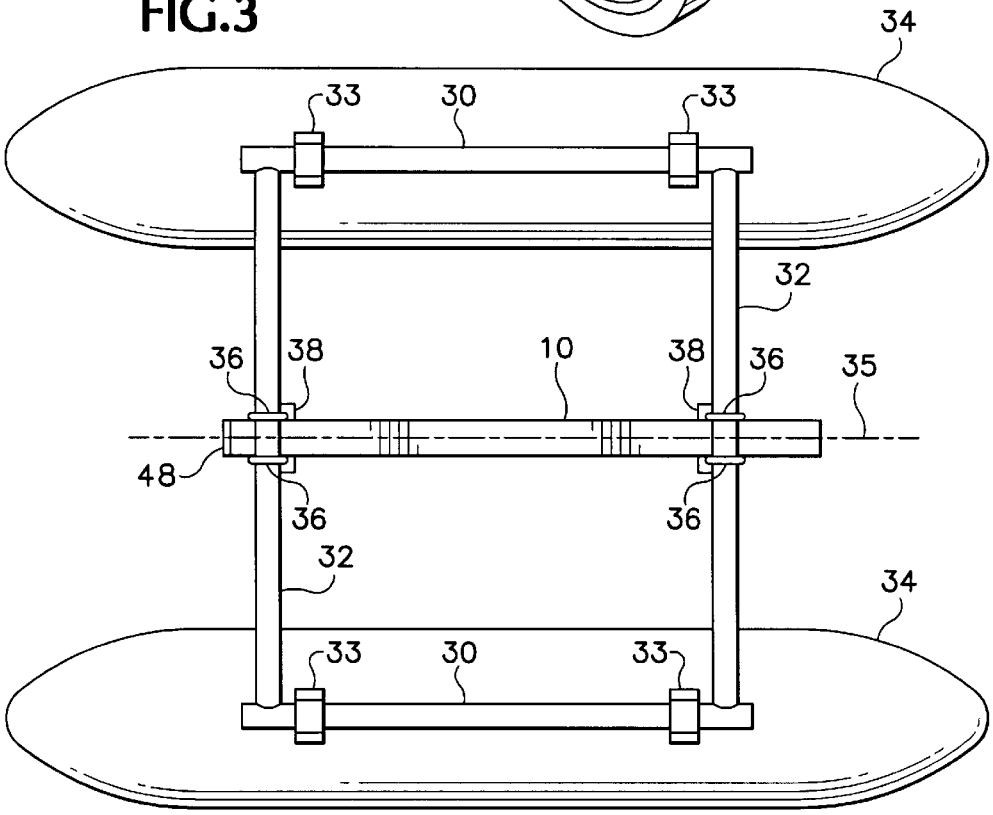
FIG. 4 is a plan view of the coupled wheel assembly and receiver of FIG. 2.
Figure 5:
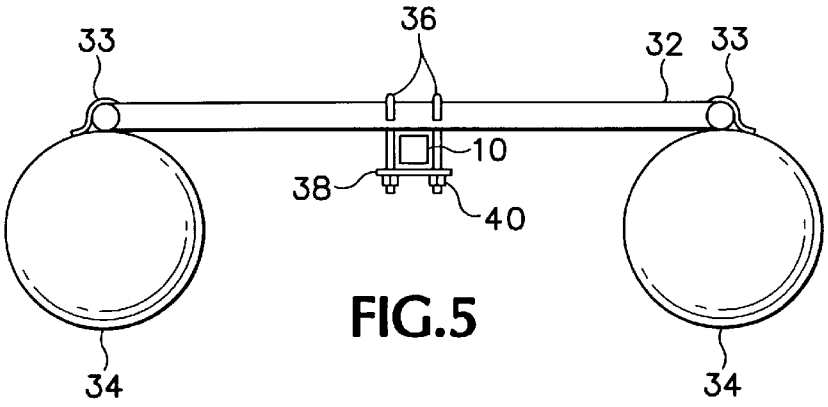
FIG. 5 is a rear elevation view of an exemplary water craft with its seat removed and a receiver attached to frame members of the water craft.

The present system was designed for, but not limited to, lighter watercraft such as pontoon rafts that are capable of being manually carried from place to place. An example of a type of pontoon raft on which the current invention can be used is shown in FIGS. 4–5. This water craft includes an aluminum frame; the representative frame shown in FIG. 4 comprises an outer pair of parallel frame members 30,30 and a pair of centrally-located frame cross-members 32,32 orthogonal to the outer frame members 30,30. Clips 33 attach each of the parallel frame members 30,30 to a pontoon 34,34, the latter providing floatation. A seat (shown in FIG. 7 at 42) generally is mounted to the parallel frame members or frame cross-members.

Figure 6:
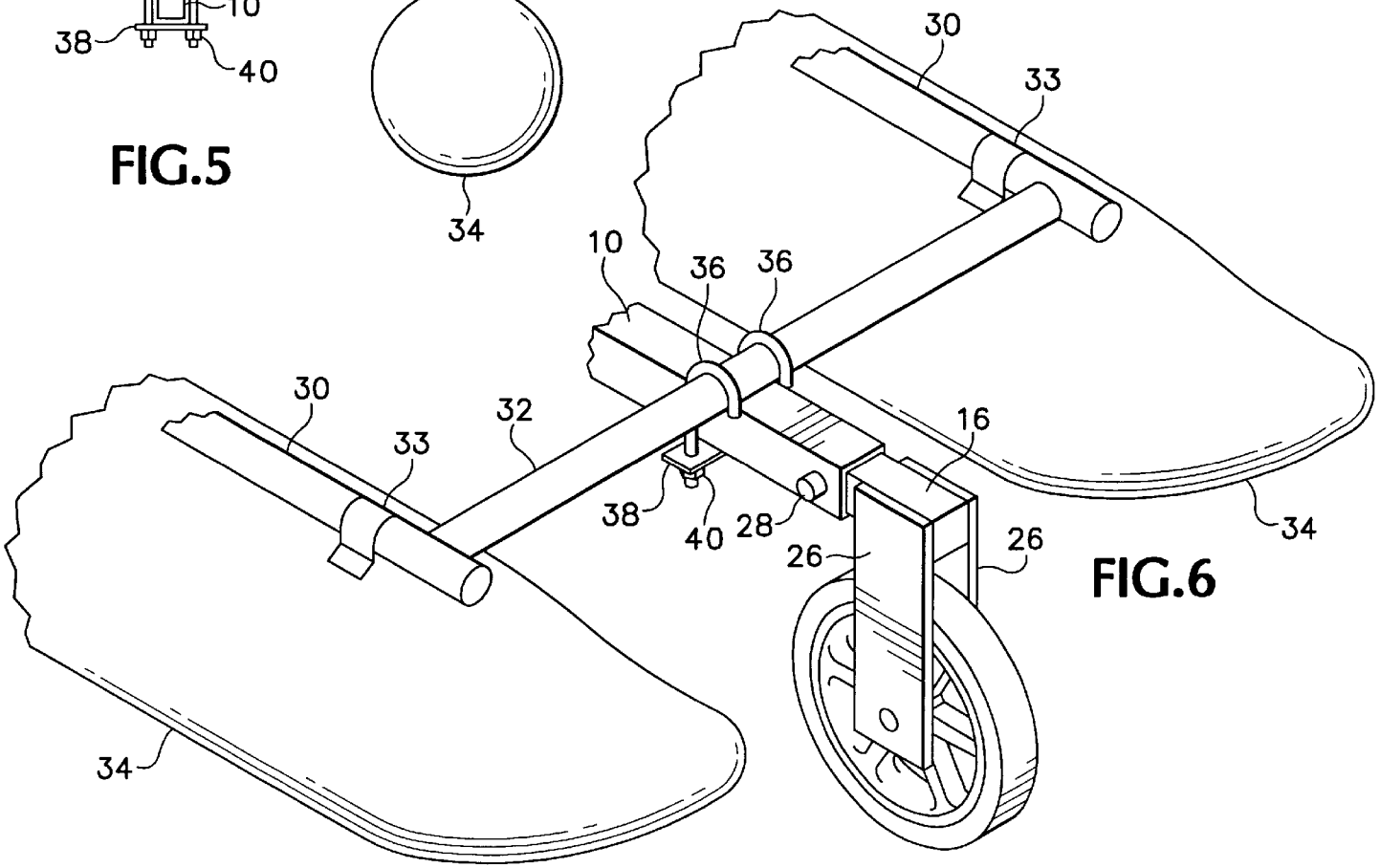
FIG. 6 is a perspective view of rear of the water craft of FIG. 4, showing the wheel assembly of FIG. 1 coupled to the receiver.

The receiver 10 is attached to the central frame of the water craft. As shown in FIGS. 4–6, the receiver can be attached by means of a plurality of hooked or J-shaped bolts 36. J-bolts 36 are fastened through a plate 38 resting against the underside of receiver member 10 via nuts 40. J-bolts 36 then pass upward on either side of receiver member 10 and hook over cross-member 32. Nuts 40 are tightened to secure receiver member 10 tightly against frame cross-member 32.

As an alternative method of attaching the receiver to the central frame of the water craft, holes can be drilled at strategic locations along the length of the receiver unit to align with coaxial holes drilled or otherwise formed in the pontoon boat frame along a center axis of the frame, or the receiver can be welded or otherwise permanently affixed to the central frame.

Preferably, the receiver 10 is mounted on the underside of the water craft frame 30,30,32,32 and preferably as close as possible along an axis of balance (i.e., axis of gravity 35), typically defined by a median sagittal plane through the frame. The receiver 10 preferably is attached to the frame with the closed end 46, covered by cap 48, facing forward and the receiving end 13 facing aft (i.e., rearward). This orientation prevents water entering the tubular receiver when the water craft is in use in the water moving forward down rapids and such.

To employ the present invention to portage a lightweight water craft, the engaging member 16 of the wheel assembly 14 is coupled to a frame-attached receiver by sliding the proximal end 18 of the engaging member 16 into the open (receiving) end of the receiver 10. The coaxial holes 22,22 of the engaging member 16 are aligned with the coaxial holes 12,12 of the receiver 10. A fastening means 28 is used to secure the coupling.

Figure 7:
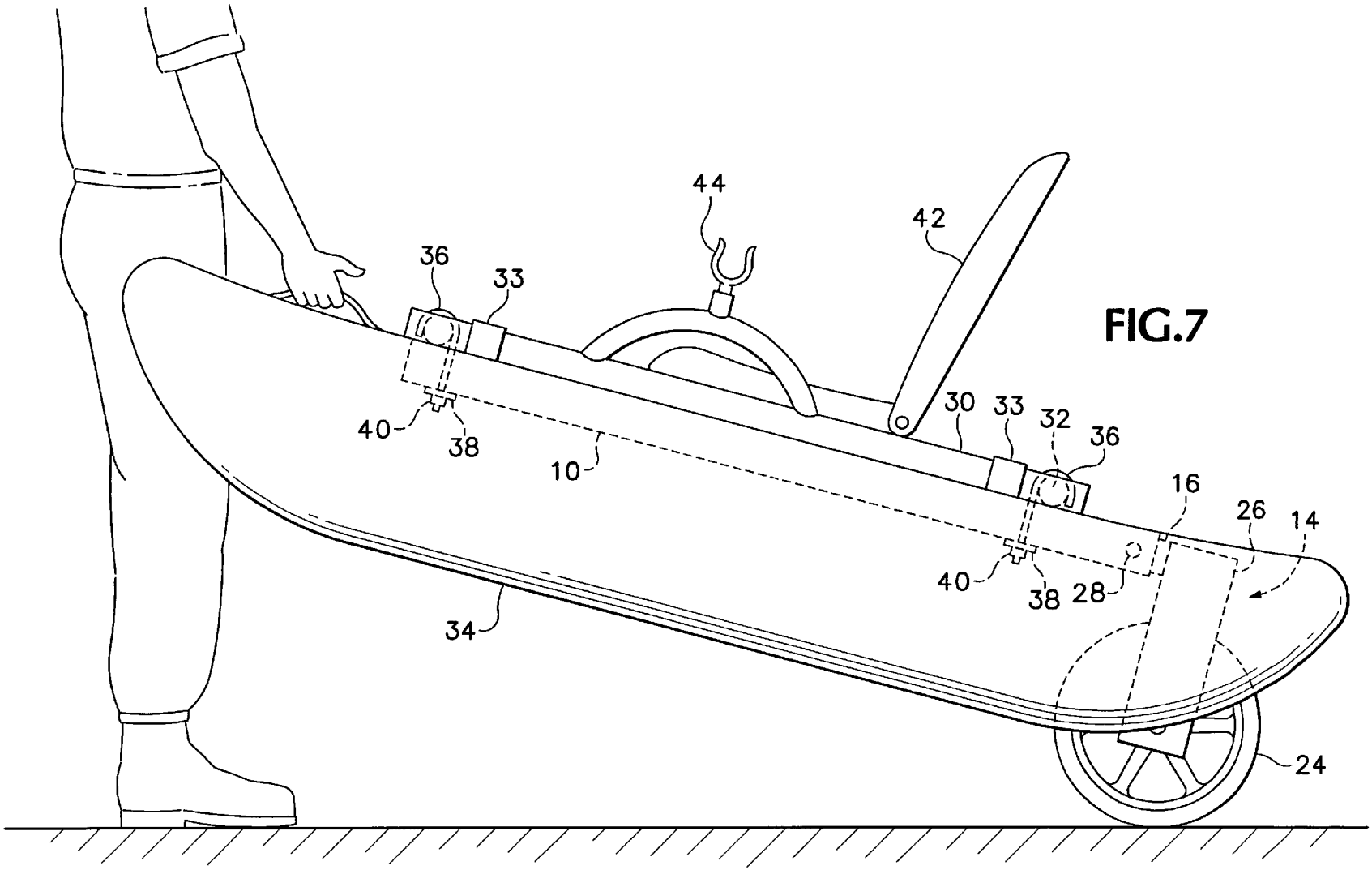
FIG. 7 is a side elevation view of a lightweight water craft being portaged wheelbarrow-style via the present invention.

Once the wheel assembly 14 is coupled to the receiver 10 (FIG. 6), a user lifts the end of the water craft opposite the coupled wheel assembly to portage the craft (FIG. 7). The user can lift the craft by grasping the pontoons 30,30 or other aspect of the craft forward of a fore-aft axis of gravity, generally defined by a median transverse plane through the craft. For example, in FIG. 7, the wheel 24 is positioned near the rear of the water craft and the user is shown grasping preexisting straps mounted on the pontoons forward of oar locks 44. The present portage apparatus thereby permits the water craft to be rolled in wheelbarrow fashion over land.

To disengage the portage apparatus, the fastening means 28 is unfastened. In the embodiment shown in FIGS. 1,2, 4–6, the pin 28 is removed from coaxial holes 12,12, and 22,22. The wheel assembly 14 then is uncoupled from the receiver 10. The wheel assembly 14 and pin 28 can then be stored until needed.

The coupling of the receiver and engaging member occurs in the preferred tubular embodiment via the insertion of the smaller-width tubular component into the larger-width tubular component. As shown in FIGS. 1,2,4–6, the larger tubular receiver 10 accepts the smaller tubular engaging member 16. However, alternative embodiments of the receiver and engaging member as well as alternative coupling methods can be envisioned. For example, the width of the tubular aspect of the receiver 10 can be smaller than that of the tubular aspect of the engaging member 16. Further, the engaging member can be rail-shaped, wherein the edges of the rail slide between accepting flanges disposed on the receiver.

A person skilled in the art will be able to practice the present invention in view of the description present in this document, which is to be taken as a whole. Numerous details have been set forth in order to provide a more thorough understanding of the invention. In other instances, well-known features have not been described in detail in order not to obscure unnecessarily the invention.

While the invention has been disclosed in its preferred form, the specific embodiments thereof as disclosed and illustrated herein are not to be considered in a limiting sense. Indeed, it should be readily apparent to those skilled in the art in view of the present description that the invention can be modified in numerous ways. The inventor regards the subject matter of the invention to include all combinations and subcombinations of the various elements, features, functions and/or properties disclosed herein.

The invention claimed is:

1. A portage apparatus for a non-inverted water craft having a central frame, the apparatus comprising:

a receiver member attached to an underside of the central frame;

means for attaching said receiver member to the central frame of the non-inverted water craft;

an engaging member having a proximal and distal end;

means for fastening said receiver member and engaging member in a selected orientation; and wheel means fixed to the distal end of the engaging member, permitting one end of the non-inverted water craft to be manually lifted and the non-inverted water craft rolled over land on said wheel means.

2. The portage apparatus of claim 1, wherein each of receiver member and engaging member is tubular and sized so as to fit one inside the other, with coaxial holes to be aligned in substantial registry.

3. The portage apparatus of claim 1, wherein receiver member is aligned with longitudinal axis of frame member of the watercraft.

4. The portage apparatus of claim 1, wherein the means for fastening is a quick-release pin.

5. The apparatus of claim 1, wherein wheel means comprises a wheel having an axle, a fork having legs attached to the axle, and a strut attached to the fork and extending orthogonal to the axle.

6. The apparatus of claim 5, wherein the strut is substantially orthogonal to the legs.

7. A portage apparatus for a lightweight catamaran-type water craft having a central frame, the apparatus comprising:

a tubular receiver member having an open end leading to a hollow interior along a longitudinal axis of said tubular receiver member, said receiver member having a pair of coaxial holes formed through a wall of the receiver member;

means for attaching said tubular receiver member to the central frame of the water craft along an axis of gravity thereof;

a tubular engaging member having a proximal and distal end with a pair of coaxial holes formed through a wall of the engaging member, the proximal end of the engaging member received through said open end of said tubular receiver member into the hollow interior so the engaging member coaxial holes and receiver member coaxial holes are in substantial registry;

a pin received through said coaxial receiver and engaging members, thereby coupling the receiver member and engaging member together; and wheel means fixed to the distal end of the tubular engaging member permitting the catamaran-type water craft to be manually lifted and rolled on said wheel means over land for portage with said catamaran-type water craft remaining in a substantially upright orientation.

8. The apparatus of claim 7, wherein the pin is a quick-release pin.

9. The apparatus of claim 7, wherein wheel means comprises a wheel having an axle, a fork having legs attached to the axle, and a strut attached to the fork and extending orthogonal to the axle.

10. The apparatus of claim 9, wherein the strut is substantially orthogonal to the legs.

11. A portagable water craft comprising:

a pair of spaced pontoons adapted to float the water craft;

a central frame coupled between the pontoons;

a tubular receiver member coupled to the central frame along an axis of gravity thereof, said tubular receiver member having an open end leading to a hollow interior;

a wheel assembly comprising:

a tubular engaging member received through the open end of the tubular receiver member into the hollow interior, said engaging member releasably coupled to said receiver member so that it can be toollessly detached from said receiver member;

a fork coupled to an end of the engaging member not received into the hollow interior of the receiver member formed out of the axis formed by the engaging member and receiver member; and a wheel coupled to the fork thereby permitting the water craft to be manually lifted and rolled on said wheel over land for portage.

12. The portage apparatus of claim 11, wherein the receiver member is attached to an underside of the central frame.

13. The portage apparatus of claim 11, wherein each of receiver member and engaging member is tubular and sized so as to fit one inside the other, with coaxial holes to be aligned in substantial registry.

14. The portage apparatus of claim 11, wherein tubular receiver member is aligned with longitudinal axis of frame member of the watercraft.

15. The portage apparatus of claim 11, wherein the receiver member is attached to an underside of the central frame.

16. The portage apparatus of claim 11, wherein the engaging member and the receiving member are adapted to be releasably coupled by a quick-release pin.

* * * * *